US011160329B2

(12) United States Patent
Gall et al.

(10) Patent No.: US 11,160,329 B2
(45) Date of Patent: Nov. 2, 2021

(54) CLIP FOR HARD HAT

(71) Applicant: MILWAUKEE ELECTRIC TOOL CORPORATION, Brookfield, WI (US)

(72) Inventors: Benjamin D. Gall, Milwaukee, WI (US); Nathan Kordik, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 16/573,788

(22) Filed: Sep. 17, 2019

(65) Prior Publication Data

US 2020/0085148 A1 Mar. 19, 2020

Related U.S. Application Data

(60) Provisional application No. 62/733,407, filed on Sep. 19, 2018.

(51) Int. Cl.
*A44B 11/06* (2006.01)
*A42B 3/04* (2006.01)

(52) U.S. Cl.
CPC ..... *A44B 11/06* (2013.01); *A42B 3/0406* (2013.01)

(58) Field of Classification Search
CPC .... A42B 3/04; A42B 3/30; A42B 3/14; A42B 3/0446; A42C 5/00; A42C 5/04; A44B 11/04; A44B 11/06; A44B 6/00; Y10T 29/49876
USPC ..... 2/6.2, 171.5, 171.7, 182.1, 174, 175.3; 24/339; 248/513, 27.6, 515, 68.1, 219.1
See application file for complete search history.

(56) References Cited

U.S. PATENT DOCUMENTS

| | | | | |
|---|---|---|---|---|
| 1,972,933 A | | 9/1934 | Harrison | |
| 2,195,068 A | * | 3/1940 | Wiley | F16B 5/121 52/718.06 |
| 2,858,538 A | | 11/1958 | Simpson | |
| 2,923,942 A | | 2/1960 | Lee et al. | |
| 3,161,931 A | | 12/1964 | Zif | |
| 3,680,031 A | | 7/1972 | Schumacher | |
| 3,802,032 A | * | 4/1974 | Weed | A44B 6/00 24/66.13 |
| 4,276,657 A | | 7/1981 | Montesi | |
| 4,463,456 A | * | 8/1984 | Hanson | A42B 3/14 2/416 |
| 4,796,308 A | | 1/1989 | Bourgeois | |

(Continued)

FOREIGN PATENT DOCUMENTS

| | | |
|---|---|---|
| DE | 501126 C | 7/1930 |
| DE | 1991783 U | 8/1968 |

(Continued)

*Primary Examiner* — Timothy K Trieu
(74) *Attorney, Agent, or Firm* — Michael Best & Friedrich LLP

(57) ABSTRACT

A clip for a hard hat includes a body having a first end and a second end opposite the first end, a plurality of longitudinally extending fingers formed in the body, and a plurality of slots formed in the body to separate the plurality of longitudinally extending fingers. The plurality of slots is in communication with openings at the second end of the body. The plurality of slots is configured to receive a strap. The clip further includes a hook portion formed in the body at the second end of the body for removably coupling the clip to the hard hat. The hook portion curves toward the first end of the body.

18 Claims, 6 Drawing Sheets

(56) References Cited

U.S. PATENT DOCUMENTS

| | | | | |
|---|---|---|---|---|
| 5,706,560 | A | 1/1998 | Anscher et al. | |
| 5,937,439 | A * | 8/1999 | Barthold | A42B 3/04 2/10 |
| 6,435,940 | B1 | 8/2002 | Fildan et al. | |
| 6,694,530 | B2 | 2/2004 | Maloney | |
| 7,665,191 | B2 | 2/2010 | Gould | |
| 7,942,889 | B2 | 5/2011 | Assia | |
| 8,510,916 | B2 | 8/2013 | Kinvi | |
| 8,706,043 | B2 | 4/2014 | Glezerman et al. | |
| 9,033,146 | B2 | 5/2015 | Higdon et al. | |
| 9,232,826 | B2 | 1/2016 | Vermillion | |
| 2009/0215360 | A1 | 8/2009 | Brideson | |
| 2009/0268153 | A1* | 10/2009 | Wang-Lee | G02C 3/02 351/155 |
| 2012/0314317 | A1 | 12/2012 | Anderson | |

FOREIGN PATENT DOCUMENTS

| | | | |
|---|---|---|---|
| DE | 2555884 | A1 | 6/1976 |
| DE | 8334934 | U1 | 3/1984 |
| DE | 20315795 | U1 | 2/2005 |
| EP | 0553037 | B1 | 3/1996 |
| WO | WO 2008040794 | A1 | 4/2008 |

* cited by examiner

CLIP FOR HARD HAT

CROSS-REFERENCE TO RELATED APPLICATIONS

This application claims priority to U.S. Provisional Patent Application No. 62/733,407 filed on Sep. 19, 2018, the entire contents of which are incorporated herein by reference.

BACKGROUND

The present invention relates to a clip for coupling a strap to a hard hat.

A strap is sometimes used with a hard hat for positioning accessories and other attachments, such as a headlamp, on the hard hat. In some scenarios, a clip is used to couple the strap to the hard hat.

SUMMARY

In one embodiment, the invention provides a clip for a hard hat. The clip includes a body having a first end and a second end opposite the first end, a plurality of longitudinally extending fingers formed in the body, and a plurality of slots formed in the body to separate the plurality of longitudinally extending fingers. The plurality of slots is in communication with openings at the second end of the body. The plurality of slots is configured to receive a strap. The clip further includes a hook portion formed in the body at the second end of the body for removably coupling the clip to the hard hat. The hook portion curves toward the first end of the body.

In another embodiment, the invention provides a clip for a hard hat. The clip includes a body having a first end and a second end opposite the first end, and a plurality of longitudinally extending fingers formed in the body. The plurality of longitudinally extending fingers includes a first finger, a second finger extending parallel to the first finger, and a third finger extending parallel to the second finger. The second finger is positioned between the first finger and the third finger. The clip further includes a plurality of slots formed in the body to separate the plurality of longitudinally extending fingers. The plurality of slots is configured to receive a strap. The plurality of slots includes a first slot, and a second slot extending parallel to the first slot. The plurality of slots is in communication with openings at the second end of the body. The openings include a first opening in communication with the first slot, and a second opening in communication with the second slot. The clip further includes a hook portion at the second end of the body for removably coupling the clip to the hard hat. The hook portion curves toward the first end of the body.

In yet another embodiment, the invention provides a method of coupling a clip to a hard hat. The method includes providing the clip. The clip includes a body having a first end and a second end opposite the first end, a plurality of longitudinally extending fingers formed in the body, and a plurality of slots formed in the body to separate the plurality of longitudinally extending fingers. The clip further includes openings in communication with the plurality of slots. The openings are at the second end of the body. The clip further includes a hook portion at the second end of the body. The hook portion curves toward the first end. The hook portion is configured to removably couple the clip to the hard hat. The method also includes inserting a strap through the openings such that a portion of the strap extends through each respective slot of the plurality of slots. The method further includes coupling the hook portion to the hard hat such that the strap is pressed between the plurality of longitudinally extending fingers and the hard hat.

Other aspects of the invention will become apparent by consideration of the detailed description and accompanying drawings.

DETAILED DESCRIPTION

Figure 1:
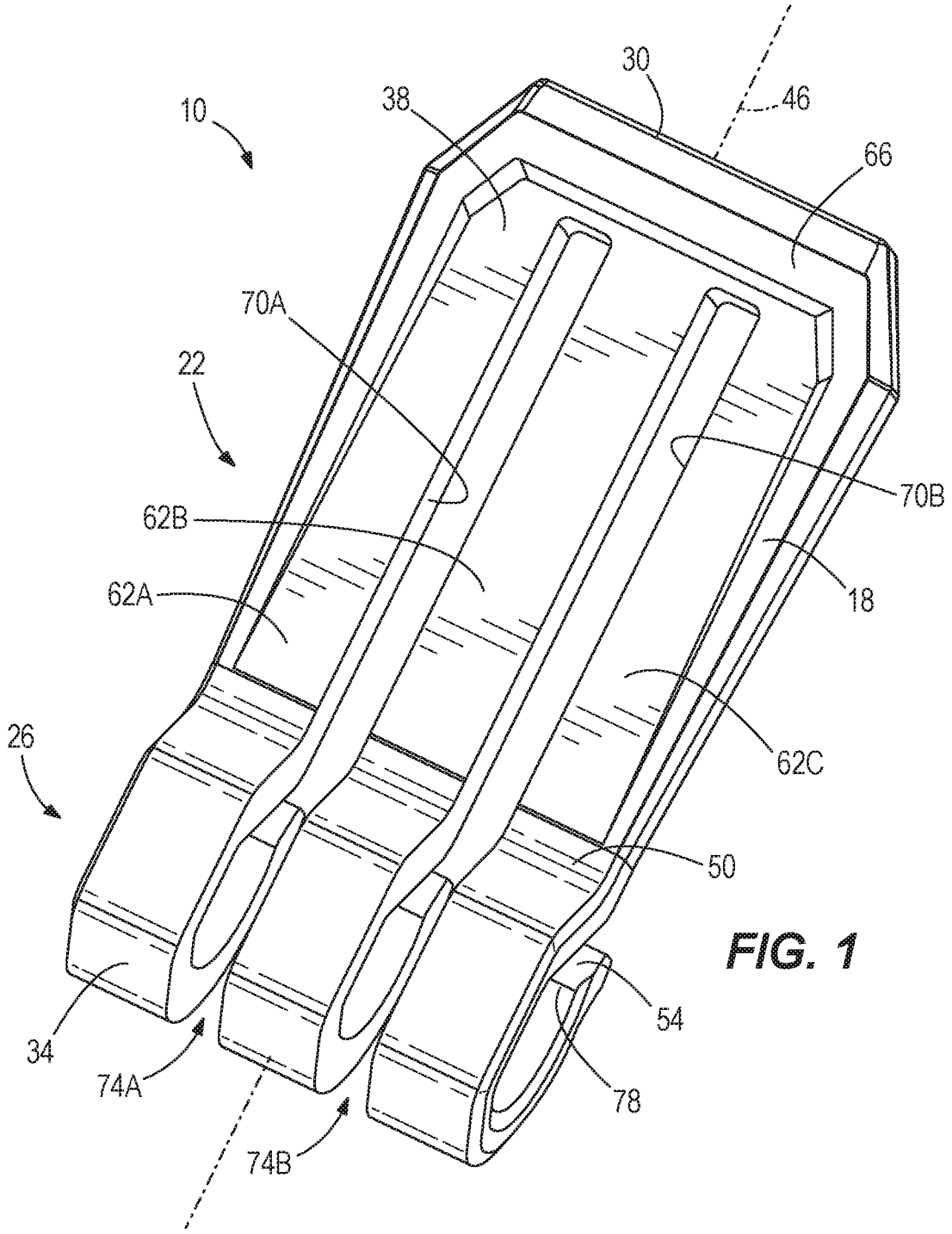
FIG. 1 is a front perspective view of a clip embodying the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-4 illustrate a clip 10 for a hat (e.g., hard hat 14; FIG. 5). The clip 10 includes a body 18. The body 18 includes a first portion 22, and a second, portion 26 coupled to the first portion 22. The first portion 22 is a planar portion. The second portion 26 is a curved portion. The illustrated body 18 extends from a first end 30 to a second end 34. The second end 34 is opposite the first end 30. The first portion 22 includes the first end 30. The second portion 26 includes the second end 34. Furthermore, the body 18 has a front side 38 and a back side 42 opposite the front side 38.

The first portion 22 defines a longitudinal axis 46 (FIG. 1) extending from the first end 30 through a third end 50. The second portion 26 extends from the third end 50 to a fourth end 54. Specifically, the second portion 26 curves from the third end 50 back on itself such that the fourth end 54 is proximate the third end 50 on the back side 42 of the clip 10 (FIG. 2). As such, the third and fourth ends 50, 54 are intermediate the first and second ends 30, 34 of the clip 10. The second portion 26 is configured to form a hook portion of the clip 10.

Figure 2:
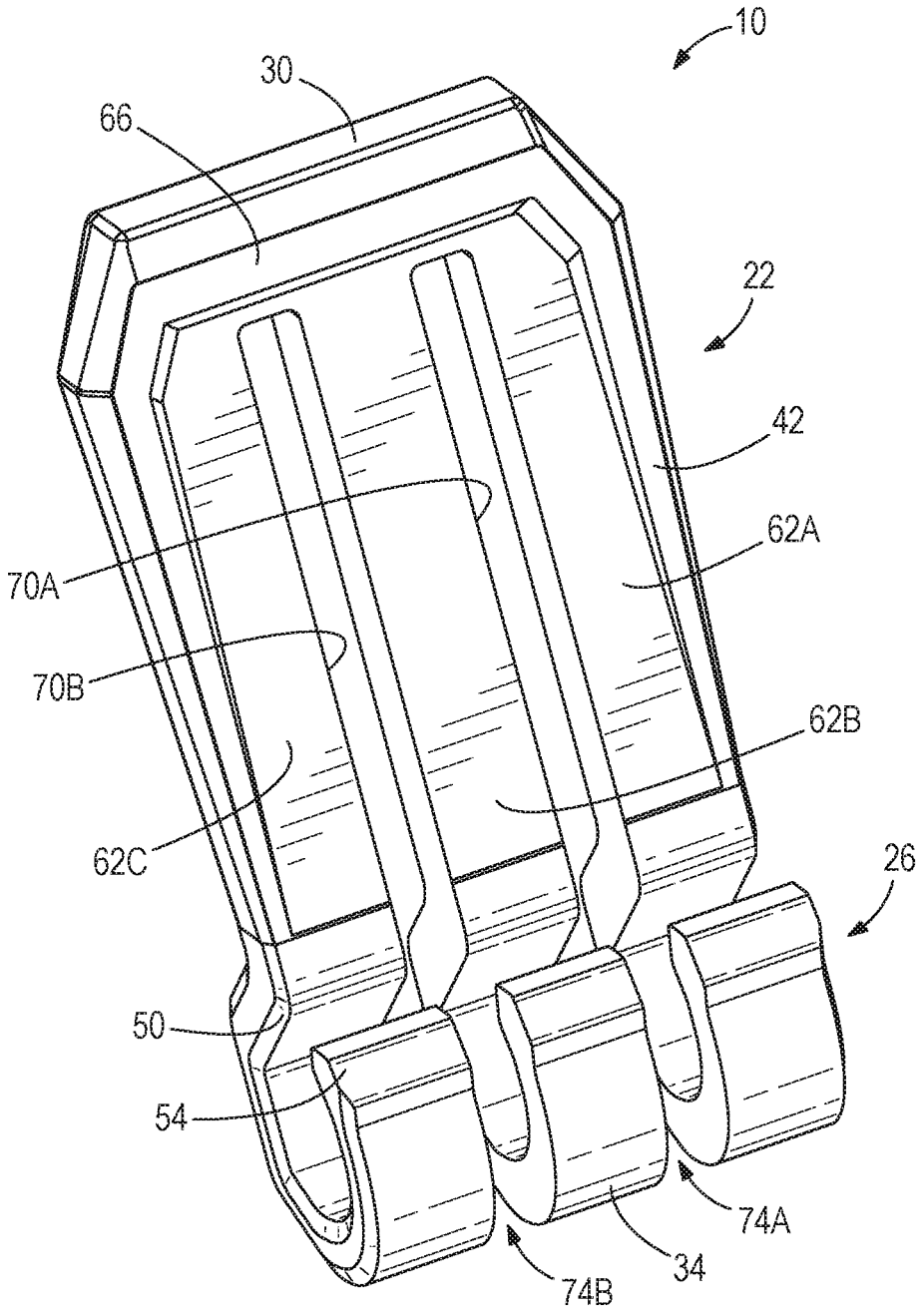
FIG. 2 is a rear perspective view of the clip of FIG. 1.
Figure 4:
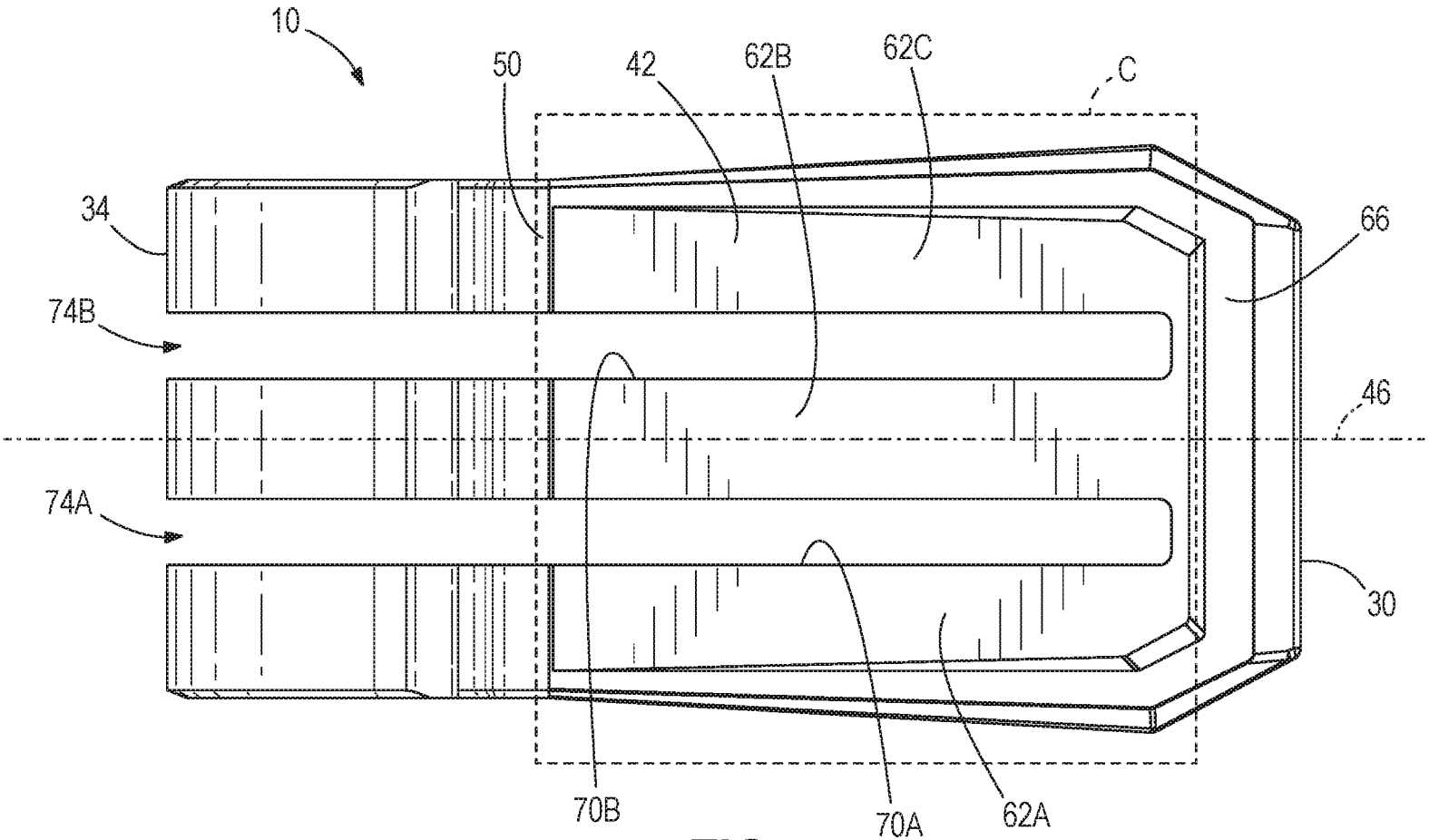
FIG. 4 is a rear view of the clip of FIG. 1.
Figure 5:
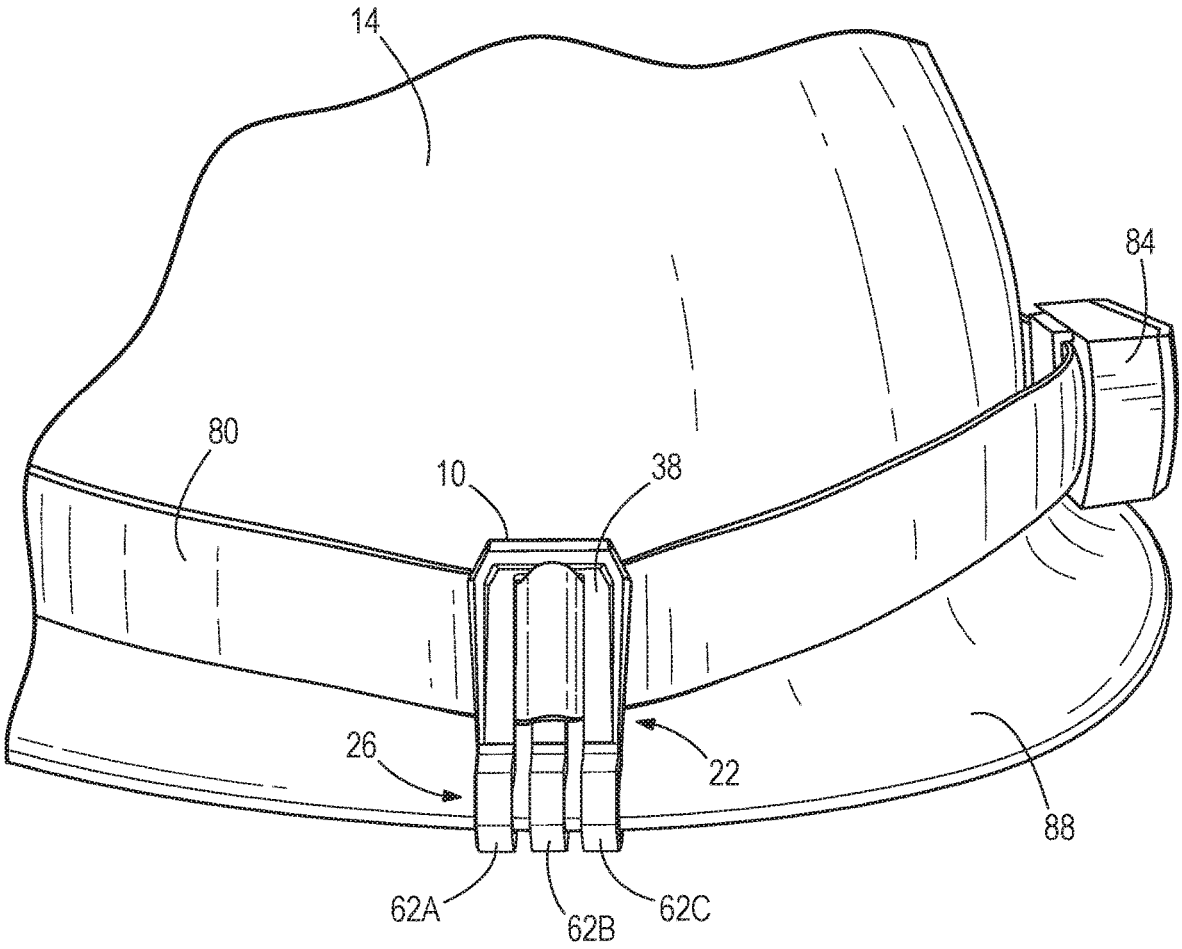
FIG. 5 is a perspective view of the clip of FIG. 1 coupling a strap to a hard hat.

With reference to FIGS. 1 and 4, the clip 10 includes a plurality of fingers 62A, 62B, 62C formed in the body 18. In the illustrated embodiment, the first portion 22 includes a top section 66, and the fingers 62A, 62B, 62C extend from the top section 66 to the fourth end 54. Each of the fingers 62A, 62B, 62C forms a portion of the first and second portions 22, 26 of the body 18. As such, each of the fingers 62A, 62B, 62C forms a portion of the hook portion. In addition, the fingers 62A, 62B, 62C extend at least partially along the longitudinal axis 46 from the top section 66 to the third end 54. The illustrated clip 10 includes three fingers 62A, 62B, 62C. Specifically, the first and third fingers 62A, 62C are outer fingers positioned on either side of the second finger 62B. In other embodiments, the clip 10 may include two or more fingers 62A, 62B, 62C.

The clip 10 includes a plurality of slots 70A, 70B formed in the body 18. The slots 70A, 70B extend from the top section 66 toward the second end 34. The slots 70A, 70B extend through the body 18. In the illustrated embodiment, the clip 10 includes two slots 70A, 70B. Specifically, a first slot 70A is defined between the first finger 62A and the second finger 62B. A second slot 70B is defined between the second finger 62B and the third finger 62C. In other embodiments, the clip 10 may include one or more slots 70A, 70B, depending on the number of fingers.

The slots 70A, 70B are in communication with openings 74A, 74B at the second end 34. For example, the first slot 70A is in communication with a first opening 74A, and the second slot 70B is in communication with a second opening 74B. As such, the second end 34 of the clip 10 is partially open, and the first end 30 (i.e., the end of the top section 66) of the clip 10 is closed. The closed, first end 30 may increase the strength and/or durability of the clip 10.

The first, planar portion 22 defines a plane C (FIG. 4). In particular, the plane C is defined by the portion of the fingers 62A, 62B, 62C which extend along the longitudinal axis 46 within the same plane. Additionally, a portion of each of the slots 70A, 70B is positioned within the plane C. Portions of the hook portion 26 are positioned outside of the plane C. In particular, the fourth end 54 of the hook portion 26 is positioned outside of the plane C (FIG. 3).

Figure 3:
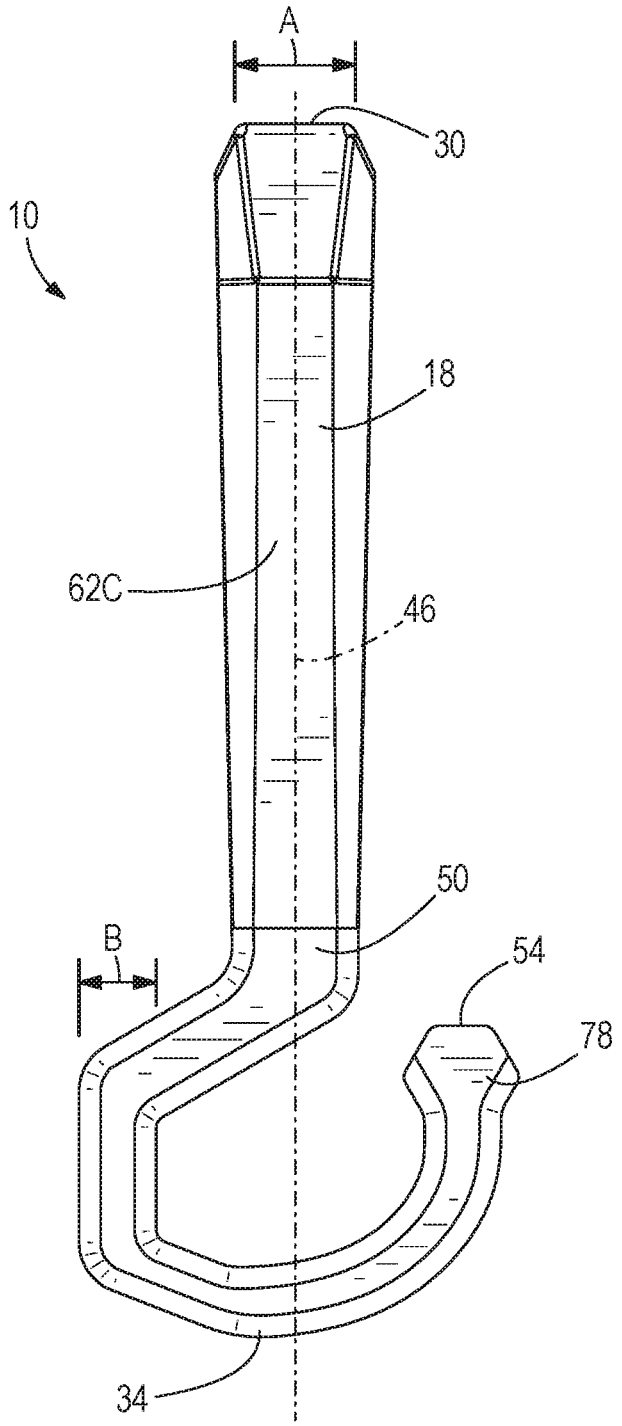
FIG. 3 is a side view of the clip of FIG. 1.

With reference to FIGS. 1-3, the clip 10 includes a protrusion 78 positioned at the fourth end 54 of the second portion 26. The protrusion 78 increases the size (e.g., thickness) of the tips of the fingers 62A, 62B, 62C at the fourth end 54. The protrusion 78 is configured to grip or hold the clip 10 to the hard hat 14, as further discussed below.

With reference to FIG. 3, the clip 10 has a predetermined thickness. The predetermined thickness is at least 0.5 inches. The first portion 22 has a thickness that is greater than a thickness of the second portion 26. In the illustrated embodiment, the first portion 22 has a first thickness A of about 0.75 inches, and the second portion 26 has a second thickness B of about 0.5 inches. In other embodiments, the first and second portions 22, 26 may have the same thickness. The thickness of the clip 10 is greater than conventional clips, which may increase durability of the clip 10. Making the first portion 22 thicker than the second portion 26 makes the first portion 22 more rigid to support a strap, while allowing the second portion 26 to more easily deflect to couple to (e.g., snap onto) the hard hat 14. Furthermore, the illustrated clip 10 is formed of a resilient material such as plastic (e.g., polyethylene, etc.) which may also increase durability of the clip 10.

Figure 6A:
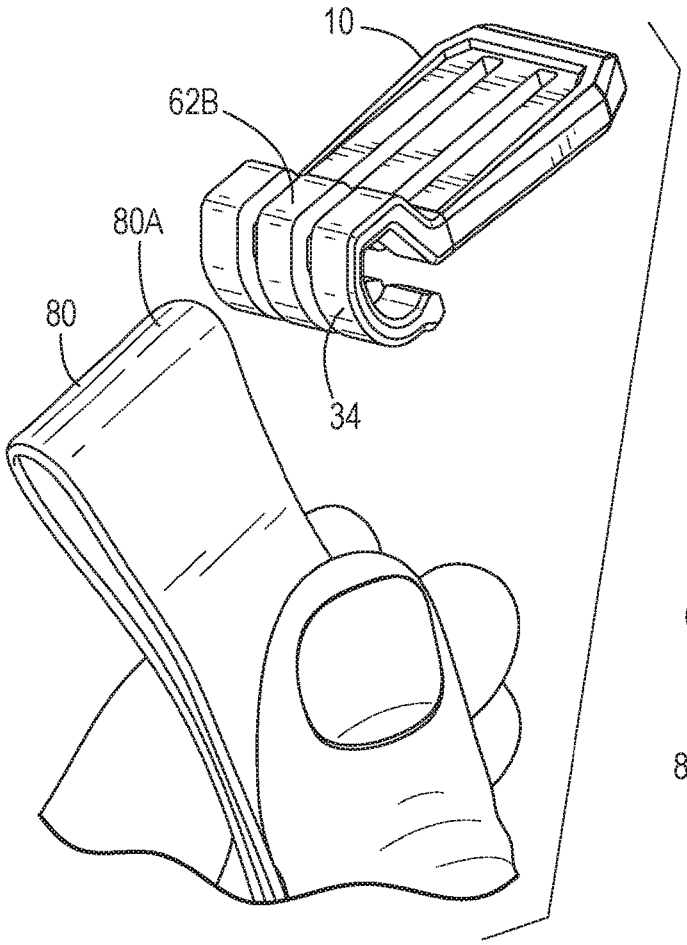
FIG. 6A is a perspective view of the clip of FIG. 1 and a strap.
Figure 6B:
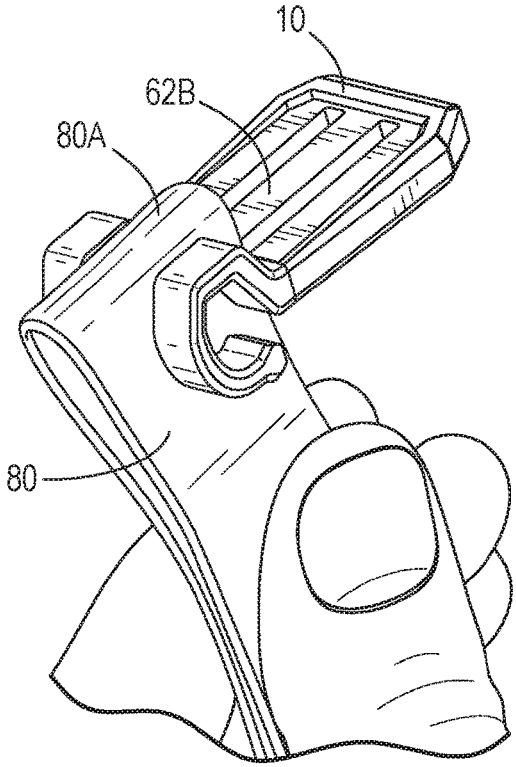
FIG. 6B is a perspective view of the clip receiving the strap of FIG. 6A within slots of the clip.
Figure 6C:
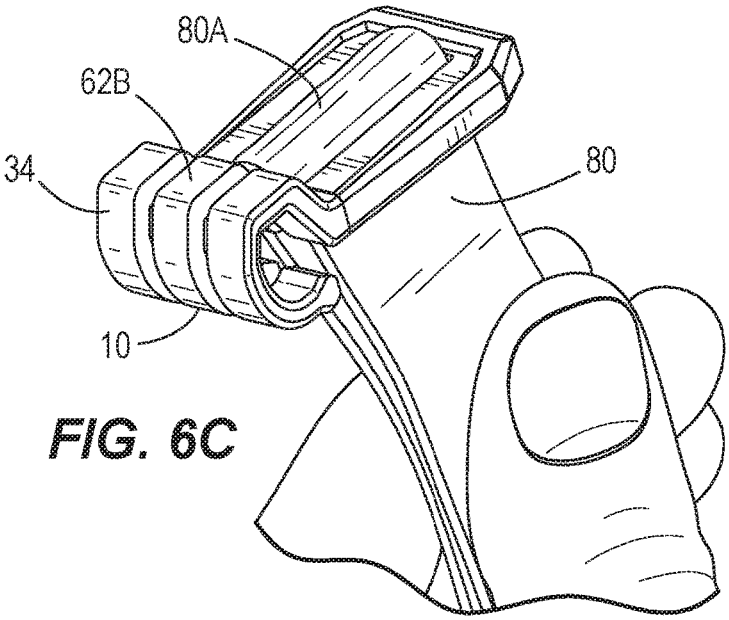
FIG. 6C is a perspective view of the strap of FIG. 6A received in the slots of the clip of FIG. 6B.

With reference to FIGS. 5-6C, the clip 10 is configured to secure a strap 80 to the hard hat 14. The strap 80 is formed by a bendable, soft material, such as cloth or an elastic band. The strap 80 may include other accessories or attachments positioned on the strap 80 for securing to the hard hat 14. In the illustrated embodiment, the strap 80 supports a headlamp 84.

With particular reference to FIGS. 6A-6C, the strap 80 is receivable within the slots 70A, 70B. Specifically, the strap 80 is configured to form a loop 80A, and the loop 80A is positionable on the second finger 62B by passing the loop 80A through the first and second openings 74A, 74B of the clip 10 at the open, second end 34.

With reference to FIG. 5, the strap 80 is positionable on the hard hat 14. The strap 80 (e.g., the loop 80A) is configured to be pressed (i.e., sandwiched) between the first and third fingers 62A, 62C, and the second finger 62B when the strap 80 is positioned on the hard hat 14. In particular, the first and third fingers 62A, 62C are configured to deflect or bend slightly outward relative to the longitudinal axis 46 at the top section 66, and the second finger 62B is configured to deflect or bend slightly inward relative to the longitudinal axis 46 at the top section 66 due to the strap 80 positioned therebetween. In addition, the positioning of the strap 80 between the middle finger 62B and the outer fingers 62A, 62C may also inhibit bunching of the strap 80 proximate the clip 10.

With continued reference to FIG. 5, the hard hat 14 includes a rim 88. The second portion or hook portion 26 is configured to secure the clip 10 including the strap 80 to the hard hat 14. Specifically, the back side 42 of the clip 10 is positioned adjacent the hard hat 14, and the hook portion 26 is engageable with the rim 88. The fourth end 54 of the clip 10 is positioned below the rim 88, and the front side 38 of the clip 10 faces away from the hard hat 14. The protrusion 78 at the fourth end 54 is configured to grip the rim 88.

In operation, a user forms the loop 80A from a portion of the strap 80 and slides the loop 80A onto the second finger 62B. Subsequently, the user positions the strap 80 on the hard hat 14, and the strap 80 is pressed between the fingers 62A, 62B, 62C. The user then slides the hook portion 26 onto the rim 88 of the hard hat 14 until the hook portion 26 snaps into place. The protrusion 78 grips the rim 88 for securing the clip 10 to the rim 88. As such, the illustrated clip 10 may be easy to install on the hard hat 14.

Thus, the invention provides, among other things, a clip for removably securing a strap to a hard hat. The clip 10 may have better durability, inhibit bunching of the strap 80 proximate the clip 10, and/or may be easy to install.

Although the invention has been described in detail with reference to certain preferred embodiments, variations and modifications exist within the scope and spirit of one or more independent aspects of the invention as described.

Various features of the invention are set forth in the following claims.

What is claimed is:

1. A clip of a hard hat, the clip comprising: a body having a first end and a second end opposite the first end; a plurality of longitudinally extending fingers formed in the body;

a plurality of slots formed in the body to separate the plurality of longitudinally extending fingers, the plurality of slots extending through the second end of the body, and the plurality of slots in communication with openings at the second end of the body and configured to receive a strap; and a hook portion formed in the body at the second end of the body for removably coupling the clip to the hard hat, the hook portion curving toward the first end of the body;

wherein each of the plurality of longitudinally extending fingers includes a first, planar portion and a second, curved portion, and wherein the second, curved portions of each of the plurality of longitudinally extending fingers form the hook portion.

2. The clip of claim 1, wherein the body includes a first, planar portion and a second, curved portion, wherein the first, planar portion forms at least a portion of each of the plurality of longitudinally extending fingers, and wherein the second, curved portion forms the hook portion.

3. The clip of claim 2, wherein the body extends from the first end to the second end, and wherein the first, planar portion includes the first end.

4. The clip of claim 3, wherein the first, planar portion extends between the first end and a third end, wherein the hook portion extends from the third end to a fourth end, and wherein the third end and the fourth end are intermediate the first end and the second end of the body.

5. The clip of claim 2, wherein the first, planar portion defines a longitudinal axis extending from the first end through a third end of the first, planar portion, and wherein the hook portion extends from the third end to a fourth end.

6. The clip of claim 5, wherein the hook portion curves from the third end back on itself such that the fourth end is proximate the third end on a side of the body.

7. The clip of claim 1, wherein the first end is closed such that the plurality of slots do not extend through the first end.

8. The clip of claim 1, wherein the hook portion includes the openings at the second end of the body such that the second end is partially open.

9. The clip of claim 1, wherein each of the plurality of longitudinally extending fingers includes a protrusion positioned at one end of the respective longitudinally extending finger, and wherein the protrusion is configured to grip a surface of the hard hat.

10. The clip of claim 1, wherein the plurality of longitudinally extending fingers includes a first finger, a second finger, and a third finger, and wherein the second finger is positioned between the first and third fingers such that the first and third fingers are outer fingers and the second finger is a middle finger.

11. The clip of claim 1, wherein the plurality of slots includes a first slot and a second slot, wherein the openings includes a first opening and a second opening, and wherein the first slot is in communication with the first opening and the second slot is in communication with the second opening.

12. The clip of claim 1, wherein the body includes a planar portion, wherein the planar portion defines a plane, and wherein the hook portion is located at least partially outside of the plane.

13. A clip of a hard hat, the clip comprising: a body having a first end and a second end opposite the first end;

a plurality of longitudinally extending fingers formed in the body, the plurality of longitudinally extending fingers including a first finger, a second finger extending parallel to the first finger, and a third finger extending parallel to the second finger, wherein the second finger is positioned between the first finger and the third finger;

a plurality of slots formed in the body to separate the plurality of longitudinally extending fingers, the plurality of slots configured to receive a strap, the plurality of slots extending through the second end of the body, the plurality of slots including a first slot, and a second slot extending parallel to the first slot, wherein the plurality of slots are in communication with openings at the second end of the body, the openings including a first opening in communication with the first slot, and a second opening in communication with the second slot; and a hook portion at the second end of the body for removably coupling the clip to the hard hat, the hook portion curving toward the first end of the body;

wherein each of the plurality of longitudinally extending fingers includes a first, planar portion and a second, curved portion, and wherein the second, curved portions of each of the plurality of longitudinally extending fingers form the hook portion.

14. The clip of claim 13, wherein the body includes a planar portion, wherein the planar portion defines a plane, and wherein the hook portion is located at least partially outside of the plane.

15. The clip of claim 14, wherein the body extends from the first end to the second end, and wherein the planar portion includes the first end.

16. A method of coupling a clip to a hard hat, the method comprising: providing the clip, the clip including a body having a first end and a second end opposite the first end, a plurality of longitudinally extending fingers formed in the body, a plurality of slots formed in the body to separate the plurality of longitudinally extending fingers, the plurality of slots extending through the second end of the body, openings in communication with the plurality of slots, the openings at the second end of the body, and a hook portion at the second end of the body, the hook portion curving toward the first end, the hook portion configured to removably couple the clip to the hard hat; inserting a strap through the openings such that a portion of the strap extends through each respective slot of the plurality of slots; and coupling the hook portion to the hard hat such that the strap is pressed between the plurality of longitudinally extending fingers and the hard hat;

wherein each of the plurality of longitudinally extending fingers includes a first, planar portion and a second, curved portion, and wherein the second, curved portions of each of the plurality of longitudinally extending fingers form the hook portion.

17. The method of claim 16, wherein inserting a strap further includes forming a loop and sliding the loop onto a middle finger of the plurality of longitudinally extending fingers.

18. The method of claim 16, wherein the hard hat includes a rim, wherein at least one of the longitudinally extending fingers includes a protrusion extending therefrom, and wherein coupling the hook portion to the hard hat further includes sliding the hook portion onto the rim until the hook portion snaps into place.

* * * * *